US007134905B1

(12) United States Patent
Kamath

(10) Patent No.: US 7,134,905 B1
(45) Date of Patent: Nov. 14, 2006

(54) CONNECTION SYSTEM WITH ELECTRONIC CIRCUIT BOARD

(75) Inventor: Shashidhar M Kamath, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/095,645

(22) Filed: Mar. 31, 2005

(51) Int. Cl.
*H01R 4/24* (2006.01)
*H01R 12/00* (2006.01)

(52) U.S. Cl. ..... 439/417; 439/76.1

(58) Field of Classification Search ..... 439/417, 439/409, 467, 596, 709, 76.1; 174/59; 29/856, 29/874

See application file for complete search history.

(56) References Cited

U.S. PATENT DOCUMENTS

| | | | | |
|---|---|---|---|---|
| 4,410,223 | A | 10/1983 | Baker | |
| 4,507,861 | A | 4/1985 | Sprenkle | |
| 4,513,353 | A | 4/1985 | Bakermans et al. | |
| 4,975,078 | A * | 12/1990 | Stroede et al. | 439/405 |
| 5,249,973 | A | 10/1993 | Fujita et al. | |
| 5,258,889 | A | 11/1993 | Belanger, Jr. | |
| 5,499,930 | A * | 3/1996 | Cieri | 439/417 |
| 5,501,611 | A * | 3/1996 | Staiger et al. | 439/404 |
| 5,759,065 | A * | 6/1998 | Hatagishi et al. | 439/596 |
| 5,762,518 | A * | 6/1998 | Tanigawa et al. | 439/409 |
| 6,109,973 | A | 8/2000 | Gronowicz, Jr. et al. | |
| 6,113,400 | A * | 9/2000 | Martin et al. | 439/76.1 |
| 6,233,153 | B1 | 5/2001 | Baur et al. | |
| 6,283,769 | B1 | 9/2001 | Asao et al. | |
| 6,305,950 | B1 * | 10/2001 | Doorhy | 439/76.1 |
| 6,383,012 | B1 * | 5/2002 | Kisu et al. | 439/404 |
| 6,430,055 | B1 | 8/2002 | Saito | |
| 6,485,332 | B1 | 11/2002 | Kwang | |
| 6,496,377 | B1 | 12/2002 | Happ et al. | |
| 6,716,056 | B1 * | 4/2004 | Hsu | 439/417 |
| 6,785,146 | B1 | 8/2004 | Koike et al. | |
| 2001/0028555 | A1 | 10/2001 | Takeuchi | |
| 2002/0085359 | A1 | 7/2002 | Masterton et al. | |
| 2004/0043647 | A1 | 3/2004 | Takeuchi | |
| 2004/0147142 | A1 * | 7/2004 | Rodrigues | 439/76.1 |

* cited by examiner

*Primary Examiner*—Hien Vu
(74) *Attorney, Agent, or Firm*—Harness, Dickey & Pierce, P.L.C.

(57) ABSTRACT

A wire harness with a housing, a circuit board, terminals, wires and a cover. The housing is formed of an electrically insulating material and has a cavity and a plurality of channels that extend between an exterior surface of the housing and the cavity. The circuit board is disposed in the cavity and includes board terminals. The terminals are coupled to the housing and the circuit board and have a first portion, which is electrically coupled to an associated one of the board terminals, and a second portion that is received into an associated one of the channels. The cover is coupled to the housing and confines the circuit board within the cavity. The wires are inserted into the second portion of a corresponding one of the terminals to electrically couple the terminals and the wires. A method for forming a wire harness is also provided.

17 Claims, 4 Drawing Sheets

CONNECTION SYSTEM WITH ELECTRONIC CIRCUIT BOARD

INTRODUCTION

The present invention generally relates electronic devices such as wire harnesses and connectors that utilize one or more circuit boards and more particularly to an apparatus and related method for reducing the direct manual handling of a circuit board as it is assembled to various components that comprise the electronic device.

Electronic components mounted to a circuit board are typically sensitive to the discharge of static electricity. The discharge of static electricity to a circuit board as it is handled during the assembly of the electronic device can damage the circuit board. As will be appreciated, damage resulting from the discharge of static electricity can be significantly reduced if the circuit board is handled less frequently. The reduction of direct manual handling of the circuit board through automation, however, can be a difficult and expensive proposition due to the complexities involved. Where volumes of the electronic device are relatively low, complex and costly automation cannot be economically justified and as such, there remains a need in the art for reducing the direct manual handling of a circuit board during the assembly of an electronic device.

SUMMARY

In one form, the present teachings provide a device, such as a wire harness assembly, that can include a housing, a circuit board, a plurality of terminals, a plurality of wires and a cover. The housing can be formed of an electrically insulating material and can have a cavity and a plurality of channels that extend between an associated exterior surface of the housing and the cavity. The circuit board can be disposed in the cavity and can include a plurality of board terminals. The terminals can be coupled to the housing and the circuit board and can have a first portion, which can be electrically coupled to an associated one of the board terminals, and a second portion that can be received into an associated one of the channels. The cover can be coupled to the housing and confine the circuit board within the cavity. Each wire can be inserted into the second portion of a corresponding one of the terminals to electrically couple the terminals and the wires.

In another form, the present teachings provide a method that can include: providing a housing having a cavity and a plurality of channels, each of the channels extending between an associated exterior surface of the housing and the cavity, the housing being formed of an electrically insulating material; placing a circuit board into the cavity, the circuit board including a plurality of board terminals; coupling a plurality of terminals to the housing and the circuit board, each terminal having a first portion, which is electrically coupled to an associated one of the board terminals, and a second portion that is received into an associated one of the channels; coupling a cover to the housing to confine the circuit board within the cavity; and coupling a plurality of wires to the terminals, each wire being inserted into the second portion of a corresponding one of the terminals.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
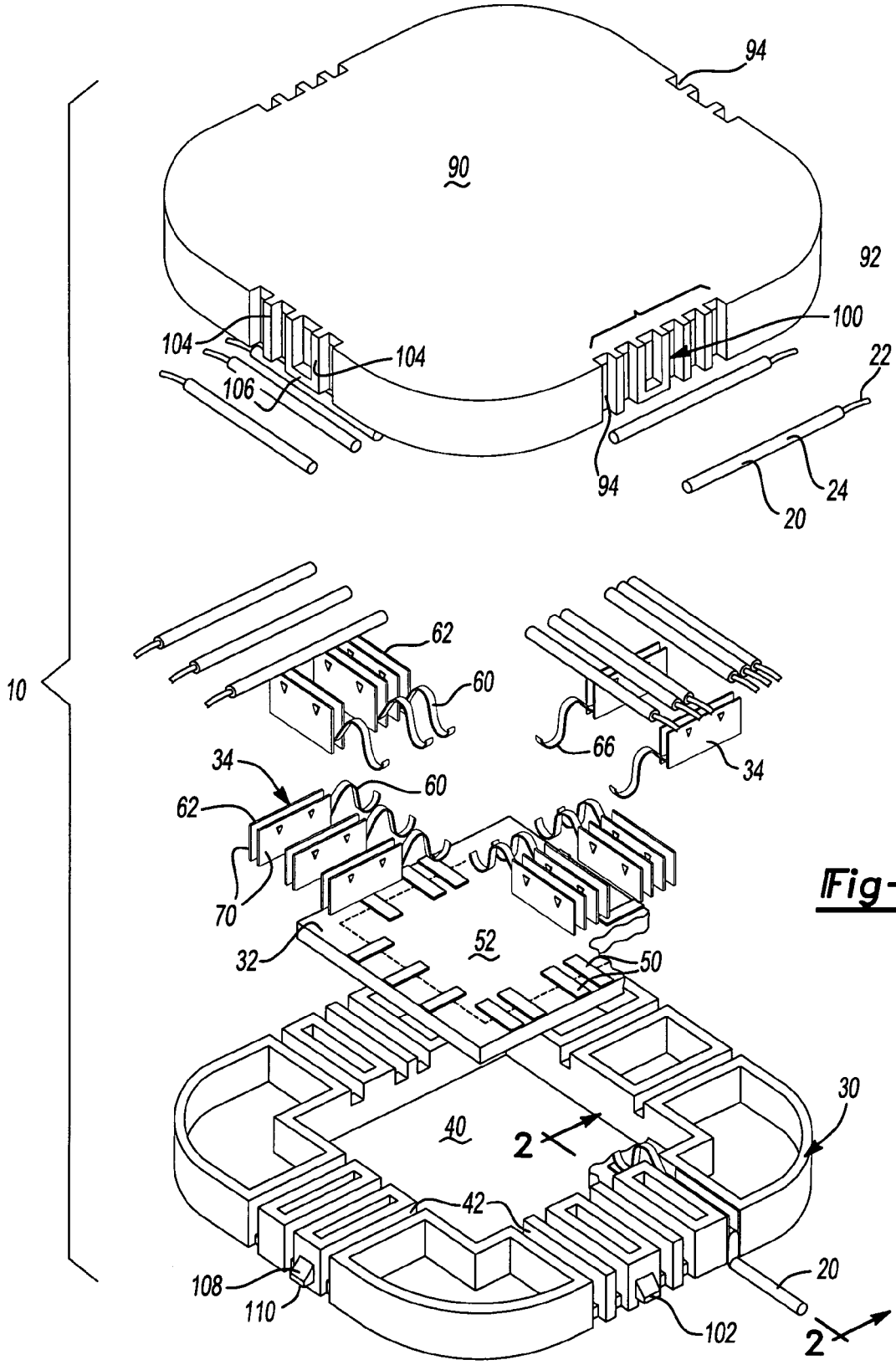
FIG. 1 is an exploded perspective view of a wire harness assembly constructed in accordance with the teachings of the present invention.
Figure 1A:
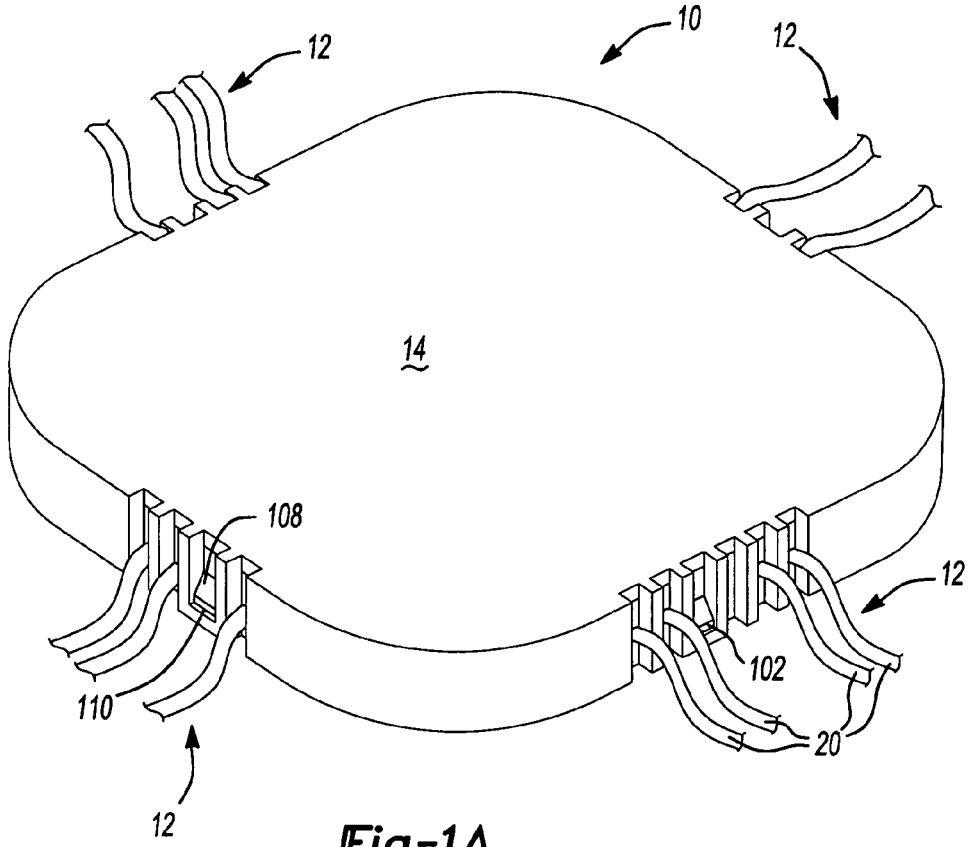
FIG. 1A is a perspective view of the wire harness assembly of FIG. 1.

With reference to FIGS. 1 and 1A of the drawings, a wire harness assembly constructed in accordance with the teachings of the present invention is generally indicated by reference numeral 10. The wire harness assembly 10 can include at least one wire harness 12 and a circuit board assembly 14. The wire harness 12 can include a plurality of wires 20, each of which having a wire portion 22 and an insulation member 24 that formed of an electrically insulating material and disposed about the wire portion 22.

Figure 2:
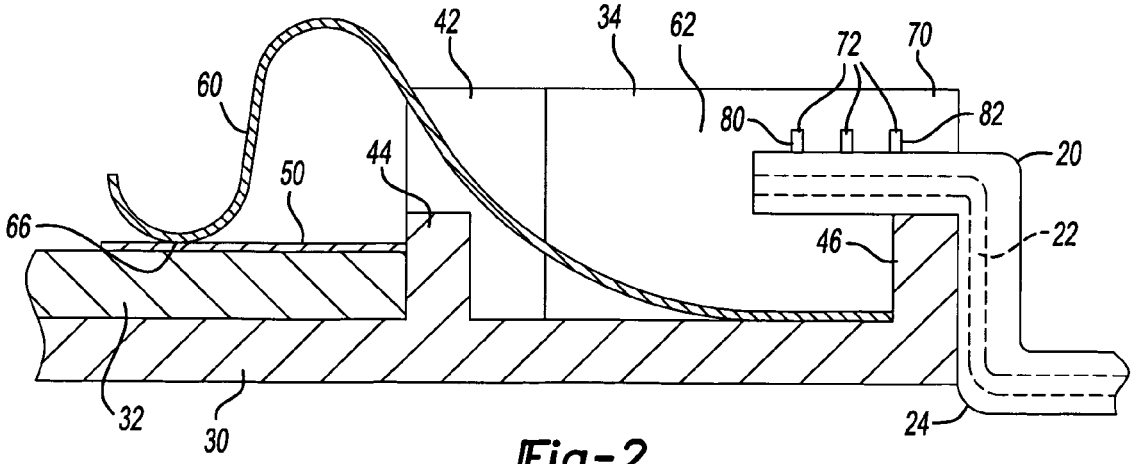
FIG. 2 is a sectional view taken along the line 2—2 of FIG. 1A.
Figure 3:
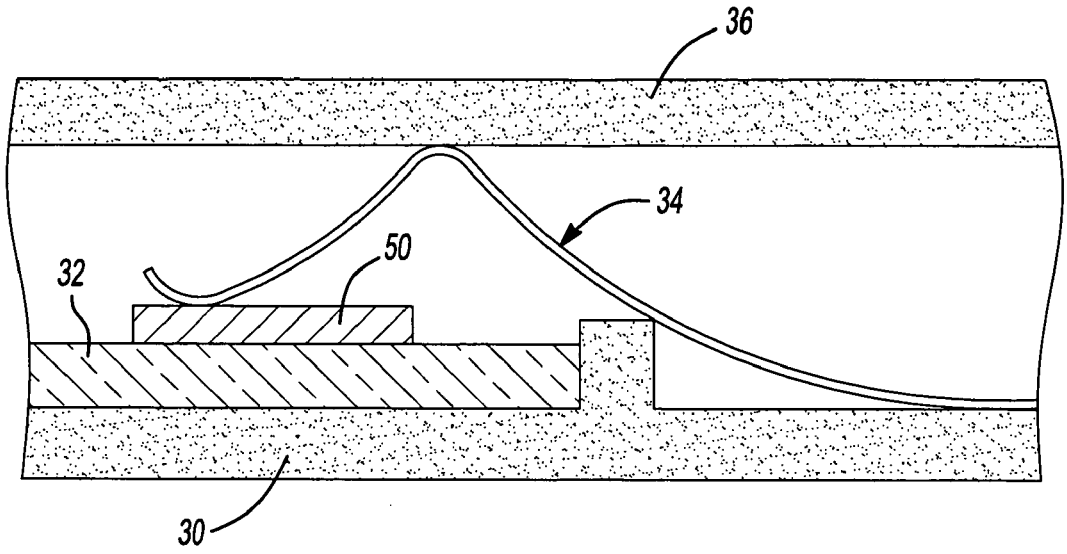
FIG. 3 is a sectional view similar to that of FIG. 2 but illustrating the cover coupled to the housing.

With reference to FIGS. 1 through 3, the circuit board assembly 14 can include a housing 30, a circuit board 32, a plurality of terminals 34 and a cover 36. The housing 30 can be formed of an electrically insulating material and can define a cavity 40 and a plurality of channels 42 that extend between a exterior surface of the housing 30 and the cavity 40. The channels 42 can be formed with upstanding inner and outer wall members 44 and 46, respectively.

The circuit board 32 can include a plurality of board terminals 50 and one or more electronic components 52 that are coupled to the board terminals 50. In its simplest form, the circuit board 32 can be one or more integrated circuits but could also include a printed circuit board to which various electronic components (e.g., integrated circuits and other solid-state electronics) can be coupled. The circuit board 32 can be disposed in the cavity 40 in the housing 30 such that each of the board terminals 50 is disposed adjacent a corresponding one of the channels 42.

Each of the terminals 34 can include a first portion 60, which can be configured to engage an associated board terminal 50, and a second portion 62 that can be coupled to the first portion 60 and configured to be received into an associated one of the channels 42. The first portion 60 can be cantilevered from the second portion 62 and can have a contact end 66 with a generally convex shape that electrically contacts the board terminal 50. It will be appreciated that construction of the first portion 60 of the terminal 34 in this manner provides the first terminal 34 with a leaf spring-like configuration that biases the contact end 66 into electrical contact with the board terminal 50 and thereby minimizes the effect of variations in the thickness of the circuit board 32, the depth of the cavity 40, the depth of the channels 42 and the extent to which the terminals 34 are received into the channels 42. The inner wall member 44 can be configured to limit movement of the first portion 60 of the terminal 34 in a direction into the cavity 40 (i.e., downwardly).

Figure 4:
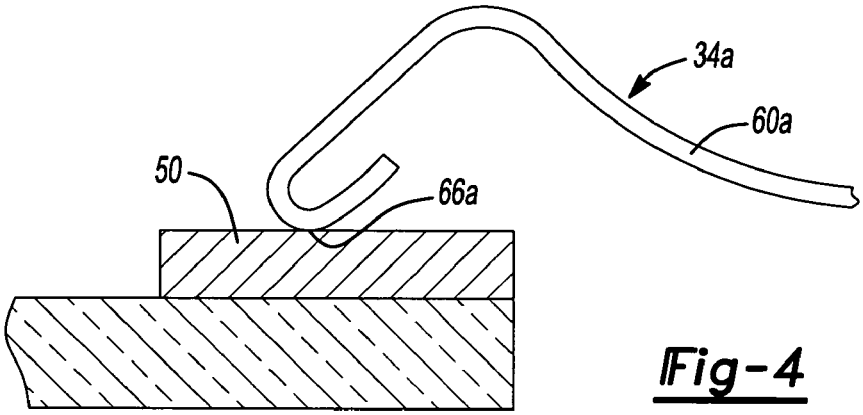
FIGS. 4 and 5 are partial sectional views similar to that of FIG. 2 but illustrating alternatively constructed terminals.
Figure 5:
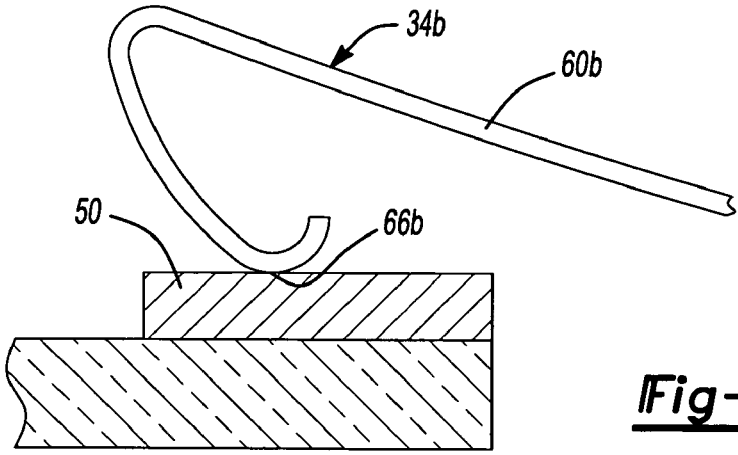

It will be appreciated that the terminals 34 may be constructed somewhat differently from that which is illustrated in FIGS. 1 through 3. In this regard, the terminals may be constructed with first portions that are configured as shown in FIGS. 4 and 5. In FIGS. 4 and 5, the terminals 34*a* and 34*b*, respectively, can include a first portion 60*a* and 60*b*, respectively, with a contact end 66*a* and 66*b*, respectively, having a generally convex shape that electrically contacts the board terminal 50. Like the terminals 34 illustrated in FIG. 1, the first portion 60*a* and 60*b* of the terminals 34*a* and 34*b* is configured in a spring-like manner so as to be forceably engaged to the board terminals 50 when the cover 36 (FIG. 1) is engaged to the housing 30 (FIG. 1).

Returning to FIGS. 1 through 3, the second portion 62 of the terminal 34 can include a pair of wall members 70 that are configured to electrically engage the wire portion 22 of an associated one of the wires 20. In the example provided, insulation displacing features 72 are coupled to the wall members 70 and permit the wire 20 to be installed to the second portion 62 of the terminal 34 without first removing a portion of the insulation member 24. Such insulation displacing features 72 are well known in the art and as such a detailed discussion of their construction and operation need not be provided herein. Briefly, the insulation displacing features 72 may include a plurality of displacement tabs 80 that are formed on one or both of the wall members 70 and extend inwardly between the wall members 70. The displacement tabs 80 can have an edge 82 that is configured to slice through the insulation member 24 and electrically engage the wire portion 22 when the wire 20 is inserted between the wall members 70. The outer wall member 46 can be configured to limit movement of the wire 20 in a downward direction to ensure that the wire portion 22 will be aligned to the displacement tabs 80.

The cover 36 can be coupled to the housing 30 to confine the circuit board 32 within the cavity 40 and to inhibit the wires 20 from disengaging the terminals 34. In the example provided, the cover 36 is unitarily formed and includes a top member 90 and an edge member 92. The top member 90 and the edge member 92 can cooperate to provide a container-like structure that can be configured to fit over the housing 30. The edge member 92 can include a plurality of slots 94 that can be aligned to the channels 42 when the cover 36 is mounted to the housing 30. The slots 94 can be of sufficient size to permit the wires 20 to be received there through as the cover 36 is placed onto the housing 30. Alternatively, the slots 94 may be relatively large so that multiple wires 20 can be located within a single one of the slots 94. Configuration in this latter manner may improve the ability to assemble the wire harness assembly 10 as it dispenses with the need to individually locate each of the wires 20 within an associated one of the slots 94.

The housing 30 and the cover 36 can include locking features that can engage one another to inhibit the removal of the cover 36 from the housing 30. The cover 36, for example, can include a plurality of engaging tabs 100 and the housing 30 can include a plurality of protrusions 102. The engaging tabs 100 can be generally U-shaped, having a pair of leg members 104 that extend downwardly from a portion of the cover 36 such as the top member 90, and an arm member 106 that is disposed between and interconnects the leg members 104. The protrusion 102 can extend outwardly from the exterior surface of the housing 30 and can include a ramp portion 108 and an abutting wall 110. When the cover 36 is engaged to the housing 30, contact between the ramp portions 108 and the arm members 106 causes the distal ends of the engaging tabs 100 to pivot outwardly so that the arm members 106 may ride over the protrusions 102. When the arm members 106 have ridden over the protrusions 102, the resilient nature of the leg members 104 causes the engaging tabs 100 to pivot inwardly toward the exterior surface of the housing 30. Contact between the abutting surfaces 110 of the protrusions 102 and the arm members 106 inhibits the withdrawal of the cover 36 from the housing 30 unless the engaging tabs 100 are first rotated outwardly so that the arm members 106 may pass over the protrusions 102.

Figure 6:
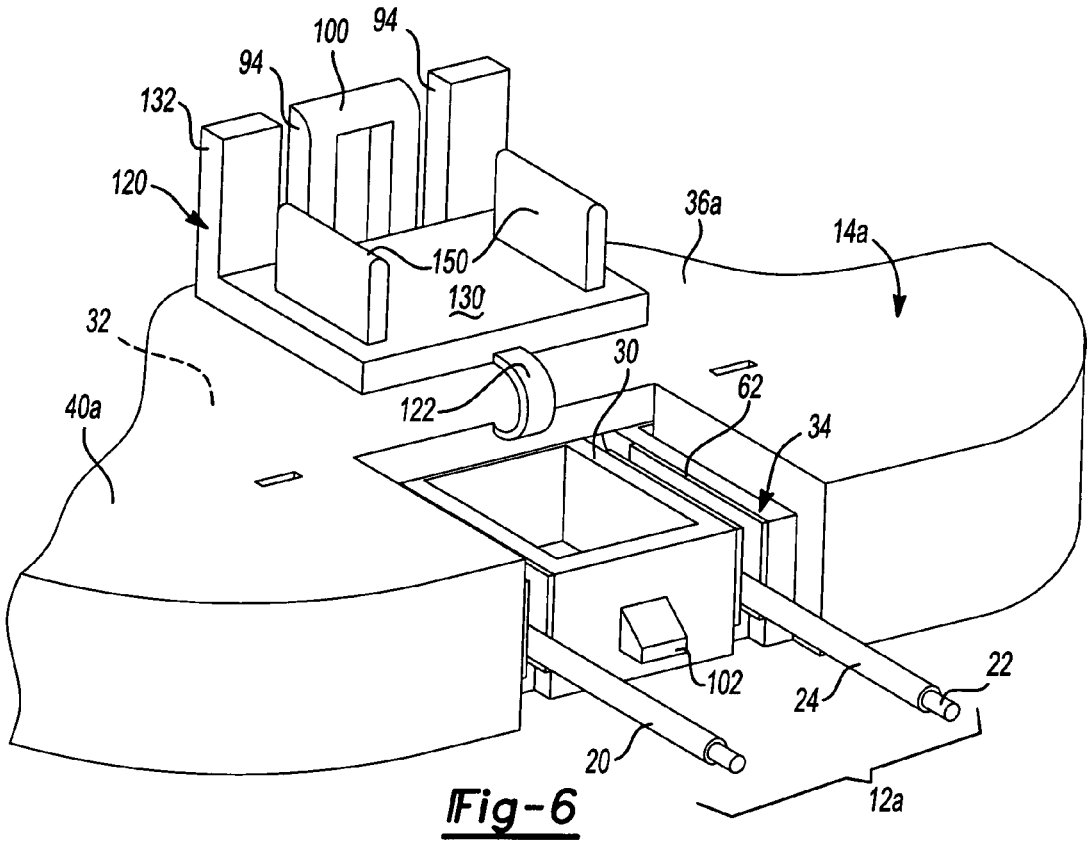
FIG. 6 is a perspective view of a portion of a second wire harness assembly constructed in accordance with the teachings of the present invention.

While the wire harness assembly 10 has been described above as having a cover 36 that is employed to simultaneously cover the circuit board 32 and each of the terminals 34, it will be appreciated that the invention, in its broadest aspects, may be constructed somewhat differently. In FIG. 6 for example, a wire harness assembly 10*a* is illustrated to include a cover 36*a* having at least one cover member 120 that is hingedly coupled to another portion of the cover 36*a*, such as the top member 90*a*. In the example provided, a living hinge 122 couples the cover member 120 to the top member 90*a* and permits the cover member 120 to be moved between an open position, which is shown in FIG. 6 and which permits access to the second portion 62 of the terminals 34 in an adjacent area, and a closed position which inhibits access to the second portion 62 of the terminals 34 in the adjacent area. The cover member 120 can be generally L-shaped, and can include a top portion 130 and a side portion 132. Like the edge member 92 (FIG. 1) described above, the cover member 120 can include one or more slots 94 through which the wires 20 of the wire harness 12*a* may extend when the cover member 120 is positioned in the closed position.

The configuration of FIG. 6 may be particularly useful where the circuit board assembly 14*a* is manufactured at one location and shipped to a second location for connection to the wire harness 12*a* as the circuit board may be enclosed within the housing 30 and the cover 36*a* in a manner that permits a technician to subsequently install the wires 20 of the wire harness 12*a* to the terminals 34. In such situations, the technician can move the cover member 120 to the open position, insert the wires 20 to the second portion 62 of respective ones of the terminals 34 and move the cover member 120 to the closed position. The cover member 120 and the housing 30 can include locking features, such as the engagement tab 100 and the protrusion 102 which are discussed in detail above, which can cooperate to maintain the cover member 120 in the closed position.

The cover member 120 can include one or more pressing members 150 that can extend from the top portion 130. The pressing members 150 can be aligned with the second portion 62 of the terminals 34 and can be configured to urge the wires 20 downwardly into the second portion 62 of the terminals 34 as the cover member 120 is moved to the closed position. Those of ordinary skill in the art will appreciate that while not shown, the pressing members 150 may optionally be incorporated on the underside of the cover 36 illustrated in FIG. 1.

Figure 7:
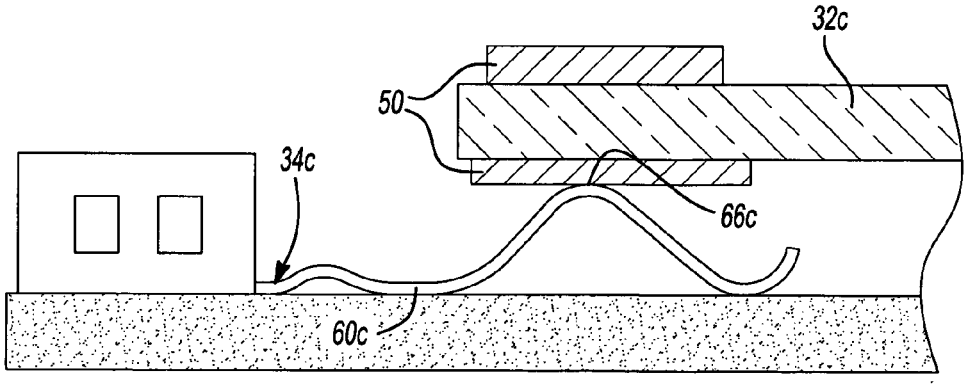
FIG. 7 is a sectional view similar to that of FIG. 3 but illustrating a third wire harness assembly constructed in accordance with the teachings of the present invention.

Those of ordinary skill in the art will appreciate that the invention, in its broadest aspects, may be constructed somewhat differently from that which is illustrated in the drawings and discussed thus far. For example, it may be desirable to configure the circuit board 32*c* with all or a portion of the board terminals 50 on a side of the circuit board 32 opposite the cover 36 (FIG. 1) as is shown in FIG. 7. In this example, the terminal 34*c* is shown to be substantially similar to the terminal 34 of FIG. 1, except that the contact end 66*c* of the first portion 60*c* can be disposed between the second portion 62*c* and the distal end of the first portion 60*c*. Configuration in this manner permits the contact end 66*c* to be supported by the housing 30 at two locations.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A method comprising:

providing a housing having a cavity and a plurality of channels, each of the channels extending between an associated exterior surface of the housing and the cavity, the housing being formed of an electrically insulating material;

placing a circuit board into the cavity, the circuit board including a plurality of board terminals;

coupling a plurality of terminals to the housing and the circuit board, each terminal having a first portion with a contact end, wherein the contact end is biased against and electrically coupled to an associated one of the board terminals, and a second portion having wall members that are received into and substantially parallel with an associated one of the channels;

coupling a cover to the housing to confine the circuit board within the cavity; and coupling a plurality of wires to the terminals, each wire being inserted into the second portion of a corresponding one of the terminals.

2. The method of claim 1, wherein each wire includes a wire portion that is surrounded by an insulation member and wherein the second portion of the terminals are configured to displace at least a portion of the insulation member when inserted to the second portion.

3. The method of claim 1, wherein the first portion of each terminal is cantilevered from the second portion.

4. The method of claim 3, wherein a contact of the first portion has a generally convex shape that contacts the associated board terminal.

5. The method of claim 4, wherein the cover includes a cover structure and at least one cover member that is hingedly coupled to the cover structure, each cover member being movable between a open portion, which provides access to the second portion of one or more of the terminals, and a closed position, which inhibits access to the second portion of the one or more of the terminals.

6. The method of claim 5, wherein one of the housing and the cover member carries an engaging tab and the other one of the housing and the cover member carries a protrusion and wherein the engaging tab and the protrusion engage one another when the cover member is in the closed position to thereby inhibit movement of the cover member to the open position.

7. The method of claim 5, wherein the cover member carries at least one pressing member, each pressing member being configured to urge an associated one of the wires into the second portion of the terminal when the cover member is moved to the closed position.

8. The method of claim 1, wherein one of the housing and the cover carries an engaging tab and the other one of the housing and the cover carries a protrusion and wherein engagement of the engaging tab and the protrusion to one another couples the housing and the cover together.

9. A device comprising:

a housing having a cavity and a plurality of channels, each of the channels extending between an associated exterior surface of the housing and the cavity, the housing being formed of an electrically insulating material;

a circuit board disposed in the cavity, the circuit board including a plurality of board terminals;

a plurality of terminals coupled to the housing and the circuit board, each terminal having a first portion with a contact end, wherein the contact end is biased against and electrically coupled to an associated one of the board terminals, and a second portion having wall members that are received into and substantially parallel with an associated one of the channels;

a cover coupled to the housing and confining the circuit board within the cavity; and a wire harness having a plurality of wires, each of the wires being inserted into the second portion of a corresponding one of the terminals to electrically couple the terminal and the wire harness.

10. The device of claim 9, wherein the cover is removably coupled to the housing.

11. The device of claim 9, wherein the terminals are insulation displacing terminals.

12. The device of claim 9, wherein the first portion of each terminal is cantilevered from the second portion.

13. The device of claim 9, wherein a contact of the first portion has a generally convex shape that contacts the associated board terminal.

14. The device of claim 9, wherein the cover includes a cover structure and at least one cover member that is hingedly coupled to the cover structure, each cover member being movable between a open portion, which provides access to the second portion of one or more of the terminals, and a closed position, which inhibits access to the second portion of the one or more of the terminals.

15. The device of claim 14, wherein one of the housing and the cover member carries an engaging tab and the other one of the housing and the cover member carries a protrusion and wherein the engaging tab and the protrusion engage one another when the cover member is in the closed position to thereby inhibit movement of the cover member to the open position.

16. The device of claim 14, wherein the cover member carries at least one pressing member, each pressing member being configured to urge an associated one of the wires into the second portion of the terminal when the cover member is moved to the closed position.

17. The device of claim 9, wherein one of the housing and the cover carries an engaging tab and the other one of the housing and the cover carries a protrusion and wherein engagement of the engaging tab and the protrusion to one another couples the housing and the cover together.

* * * * *